United States Patent [19]

Hasebe

[11] Patent Number: 4,610,368

[45] Date of Patent: Sep. 9, 1986

[54] TABLEWARE BASKET FOR A TABLEWARE WASHER

[75] Inventor: Tsutomu Hasebe, Kashiwa, Japan

[73] Assignee: Tezuka Kosan Kabushiki Kaisha, Tokyo, Japan

[21] Appl. No.: 771,001

[22] Filed: Aug. 30, 1985

[30] Foreign Application Priority Data

Sep. 3, 1984 [JP] Japan ..... 59-132674[U]

[51] Int. Cl.[4] ..... B65D 6/08; B65D 1/36

[52] U.S. Cl. ..... 220/19

[58] Field of Search ..... 220/19, 83, 84, 72, 220/DIG. 15; 206/557, 562, 564, 553, 373; 4/189, 190, 290; 211/41, 126

[56] References Cited

U.S. PATENT DOCUMENTS 4,192,432 3/1980 Jordan ..... 220/19

4,318,478 3/1982 De Winter ..... 220/19

4,372,351 2/1983 Myers ..... 220/19

*Primary Examiner*—George T. Hall

[57] ABSTRACT

Present invention relates to a tableware basket for receiving and holding spoons, forks and knives to be washed by a tableware washer.

The feature of the present invention is that the tableware basket pivotally placed in the washing tank for the tableware washer is coupled with a plurality of connecting wires spaced for connecting the ring wires located at the upper and lower portions and provided therein with holding basket zones plurally divided by accommodating division lines, and the holding basket zones are composed of enabling spoons, forks, knives, etc. to be held in upstanding positions or of enabling the basket containing spoons, etc. to insert therein and detach therefrom.

2 Claims, 2 Drawing Figures

TABLEWARE BASKET FOR A TABLEWARE WASHER

BACKGROUND OF THE INVENTION

The present invention relates to a tableware basket (Rack) for receiving and holding spoons, forks, knives, etc. to be washed by a tableware washer.

The customary method used for washing these spoons, forks, knives, etc. is that a plurality of such spoons, forks, knives, etc. laid down on their sides are piled up on a rack, then accomodated in the tableware washer, and washed by a shower jet discharging over them, and subsequently, these are taken out from the washer, and residual filth is removed by hand washing means.

In this example, the tableware washer could remove only filth being stuck to the faces of spoons, etc. piled up on the rack, and cleaning it more thoroughly had to resort to the hand washing. Therefore, large restaurants needed much of manpower; it was a very troublesome job requiring much time and much labor.

A DETAILED DESCRIPTION OF THE INVENTION

An object of the present invention is to provided a tableware basket for the tableware washer such that spoons, forks, etc. can completely be washed without washing by hands, therby contributing to a large-scale saving of manpower.

Another object of the present invention is to provide a rack such that if the holding basket is freely attachable and detachable, spoons, etc. can be put in and taken out with ease, and that if a spare basket is used, it can be ready for quick replacement and that the basket can be compensated as to any possible damage.

A feature of the present invention lies in comprising; In the washing tank for a tableware washer is formed at least upper and lower ring wires constituting a peripheral edge pivotally shaped therein, the upper and lower ring wires are coupled with a plurality of connecting wires separated by spaces, a plurality of accomodating divisions are in a plain form divided by accomodating division lines, and within the accomodating division lines are provided holding basket zones for enabling spoons, forks, knives, etc. to be held in upstanding positions, and the holding basket zones are freely attachable and detachable within the accomodating division lines.

Another feature of the present invention will be more apparent from the following description of an embosiment in accordance with the present invention taken in conjunction with the accompanying drawings.

DESCRIPTION OF THE PREFERRED EMBODIMENTS

Figure 1:
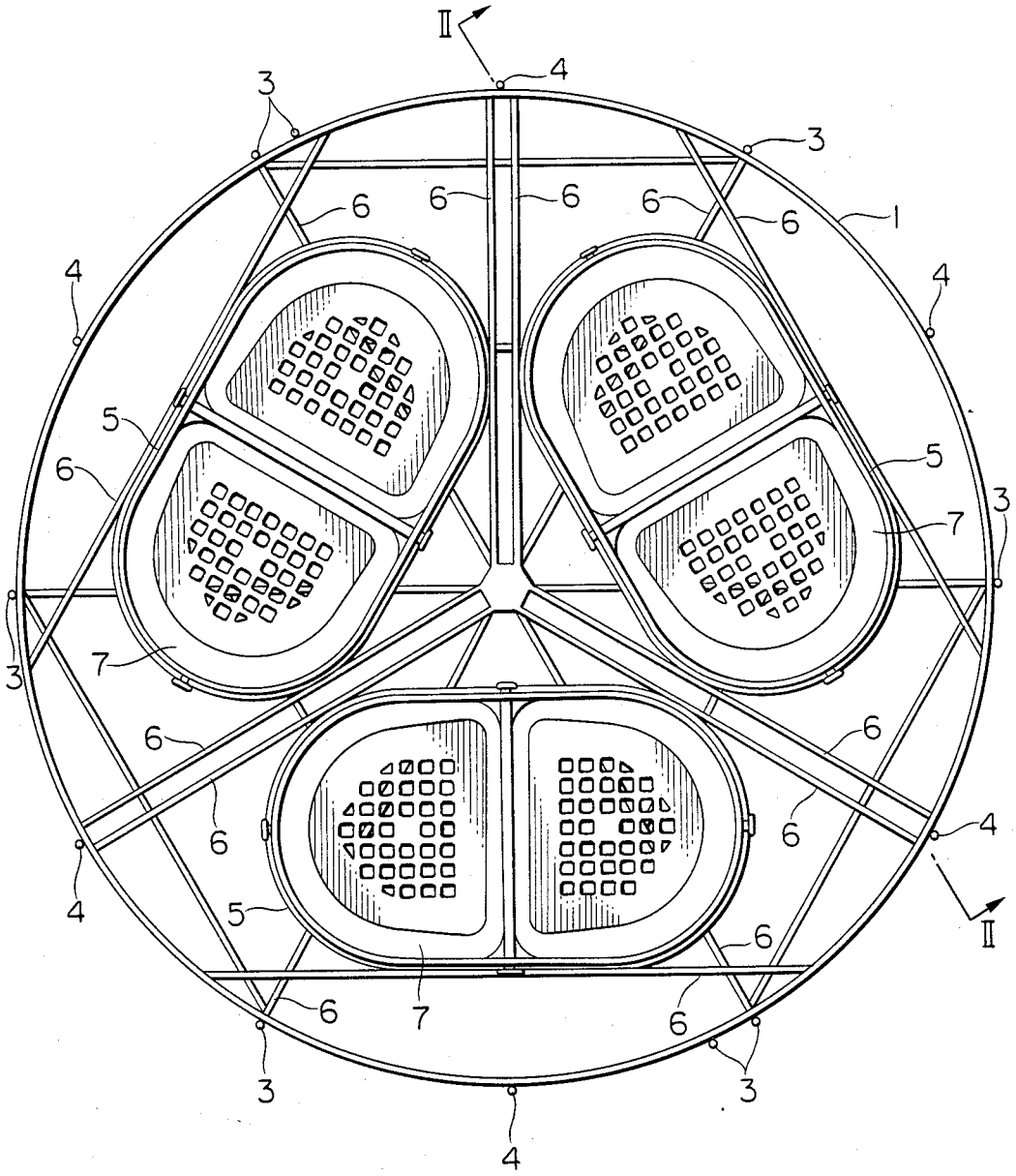
FIG. 1 is a plan view.
Figure 2:
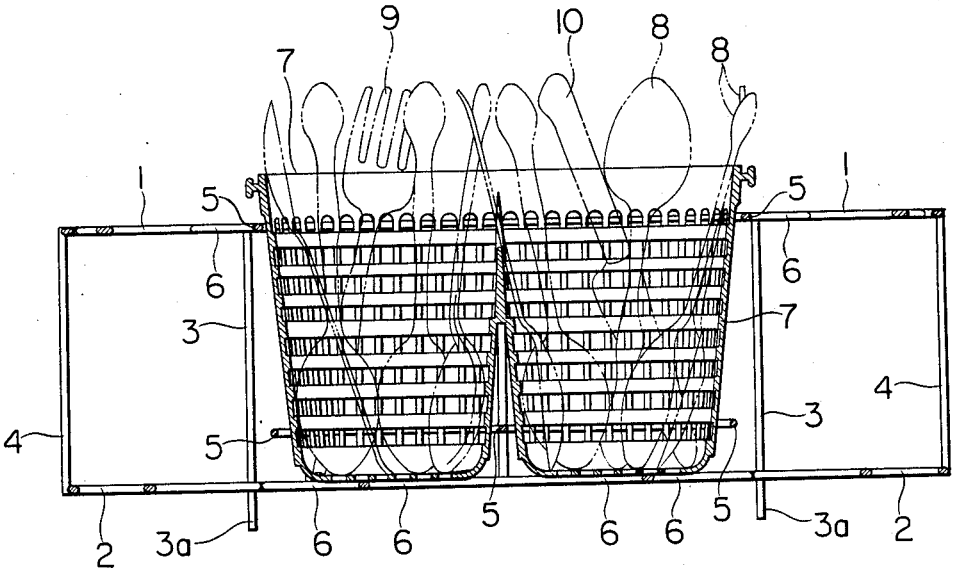
FIG. 2 is a section taken along line 11—11 of FIG. 1.

As illustrated in FIG. 1 and FIG. 2, the upper and lower wires 1, 2 for the rack are made of steel wires. The upper and lower ring wires 1, 2 are formed in a circle of similar diameter so as to be capable of being rotated in the washing tank for the tableware washer.

These wires 2, 2 are coupled at required intervals with a plurality of connecting wires 3 - - - , 4 - - -. The connecting wires 3 extend downwardly form the lower ring wire 2 forming legs 3*a*. In a plain form the accomodating division lines 5 for dividing a plurality of accomodating divisions are coupled to and supported by rings 1, 2 and connecting wires 3, 4 through supporting wires 6. Within the accomodating division lines are provided the holding basket zone 7. The holding basket zones 7 - - - are mounted attachable and detachable within the accomodating division lines 5 - - -. All surfaces of the holding basket zone are set for the size and depth of their meshes in order that spoons 8, forks 9 and knife 10 may be held without falling off when they are keld with a plenty of space in upstanding positions and that washing liquid may be free to come in and out through them.

As another example, the holding basket zone may be integrally formed by coupling meshes, etc. to the accomodating division lines 5. And, it may be one wherein the accomodating division lines are formed to arrange the accomodating divisions in a radial form or it may be one wherein more accomodating divisions are formed.

Next, a description will be given as to how the present invention works.

The rack which is holding spoon 8, fork 9 and knife 10 in upstanding positions with a plenty of space in the holding basket zone 7 is placed into the washing tank for the tableware, then perform washing while revolving the rack itself and the washing liquid within the washing tank. The washing liquid will be hit upon all the corners of all spoons, etc. from all directions by rotation of the spoon 8, etc. itself in the holding basket zone 7 and the washing liquid. A collision of the washing liquid will cause the spoon itself to be quivered and moved its position, further extending all over, thereby washing is done.

Thus, filth can be removed from all the corners of respective spoons in a short time and washing comes to an end.

What is claimed is:

1. A tableware basket for the tableware washer comprising:

in the tableware basket for use with the tableware washer wherein the tableware basket placed in the tableware basket for the tableware washer is rotatable, and the washing liquid in the washing tank is also rotatable, at least upper and lower ring wires 1, 2 constituting a peripheral edge pivotally shaped in the washing tank, a plurality of connecting wires 3, 4 spaced for connecting said upper and lower ring wires, and accomodating division lines 5 dividing a plurality of accomodating divisions in a plain form are provided, and within said respective accomodating division lines are the holding basket zones 7 enabling spoon 8, fork 9, knife 10, etc. to be held in upstanding positions.

2. A tableware basket for the tableware washer in accordance with claim 1 wherein the holding basket zone 7 is attachable and detachable within the accomodating division line.

* * * * *